US008565283B2

(12) United States Patent
Lewin

(10) Patent No.: US 8,565,283 B2
(45) Date of Patent: Oct. 22, 2013

(54) INSERT AND A HEATER ELEMENT FOR ELECTRICAL FURNACES

(75) Inventor: Thomas Lewin, Hallstahammar (SE)

(73) Assignee: Sandvik Intellectual Property AB, Sandviken (SE)

( * ) Notice: Subject to any disclaimer, the term of this patent is extended or adjusted under 35 U.S.C. 154(b) by 0 days.

(21) Appl. No.: 12/449,960

(22) PCT Filed: Jan. 2, 2008

(86) PCT No.: PCT/SE2008/050004
§ 371 (c)(1),
(2), (4) Date: Sep. 4, 2009

(87) PCT Pub. No.: WO2008/108713
PCT Pub. Date: Sep. 12, 2008

(65) Prior Publication Data

US 2010/0111132 A1 May 6, 2010

(30) Foreign Application Priority Data

Mar. 5, 2007 (SE) ..... 0700559

(51) Int. Cl.
*H05B 3/62* (2006.01)
*H05B 3/66* (2006.01)
*H05B 3/03* (2006.01)

(52) U.S. Cl.
USPC ..... 373/117; 373/130; 373/131; 373/134

(58) Field of Classification Search
USPC ..... 373/139, 117, 119, 131, 134, 125, 118, 373/3, 130, 109, 127; 219/420, 553, 538, 219/552, 528, 628, 638; 392/451, 453, 304, 392/447, 459; 122/510, 511
See application file for complete search history.

(56) References Cited

U.S. PATENT DOCUMENTS 1,588,611 A * 6/1926 Reid ..... 373/130
1,626,656 A * 5/1927 Woodson ..... 373/119
(Continued)

FOREIGN PATENT DOCUMENTS

EP 1 010 355 6/2000
JP 62-144333 6/1987
(Continued)

OTHER PUBLICATIONS

English translation of Hosaka et al. (JP 7-183238), Heating Device, Jul. 21, 1995.*
(Continued)

*Primary Examiner* — Henry Yuen
*Assistant Examiner* — Hung D Nguyen
(74) *Attorney, Agent, or Firm* — Morgan, Lewis & Bockius LLP

(57) ABSTRACT

An insert intended for electrical furnaces and of the type that includes an insulating shell having an outside and an inside having a rotationally symmetrical, e.g., cylindrical shape, and a heater element that is arranged inside the insulating shell and extends several turns in a continuous loop having an overall shape corresponding to the rotationally symmetrical shape of the insulating shell. The continuous loop includes spaced-apart bends, which divide the same into individual sections of limited length to which occurring thermal expansion is isolated locally. In an exemplary embodiment, the bends are U-shaped to impart to the continuous loop a meander shape. Another exemplary embodiment relates to a heater element.

5 Claims, 3 Drawing Sheets

(56) References Cited

U.S. PATENT DOCUMENTS

Figure 1:
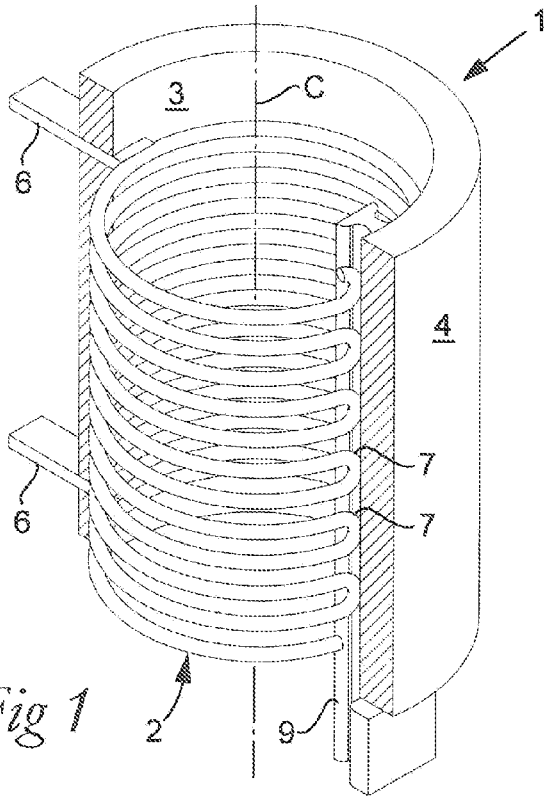

| | | | | | |
|---|---|---|---|---|---|
| 1,695,882 | A | | 12/1928 | Colby | |
| 1,921,543 | A | * | 8/1933 | Schonfeld | 219/542 |
| 2,162,030 | A | * | 6/1939 | Piazzoli, Jr. | 373/117 |
| 3,350,493 | A | * | 10/1967 | Randall | 373/119 |
| 4,553,246 | A | | 11/1985 | Christie | |
| 5,038,019 | A | * | 8/1991 | McEntire et al. | 219/390 |
| 6,008,477 | A | | 12/1999 | Nakao et al. | |
| 6,807,220 | B1 | * | 10/2004 | Peck | 373/128 |
| 2002/0090209 | A1 | * | 7/2002 | VonArx et al. | 392/451 |
| 2005/0069014 | A1 | | 3/2005 | Uemori | |
| 2005/0141586 | A1 | * | 6/2005 | Sakaguchi et al. | 373/119 |

FOREIGN PATENT DOCUMENTS

| | | | | |
|---|---|---|---|---|
| JP | 62-144333 | A | | 6/1987 |
| JP | 07-058046 | | | 3/1995 |
| JP | 7-183238 | A | * | 7/1995 |
| JP | 2001-313153 | | | 9/2001 |

OTHER PUBLICATIONS

Abstract of Hosaka et al. (JP 7-183238), Heating Device, Jul. 21, 1995.*

European Search Report for 08705277.5, dated Dec. 16, 2011.

JPO—Japanese Patent Application No. 2009-553632—Notice of Reasons for Rejection (Office Action)—Mailed on Nov. 20, 2012.

Japanese Office Action and English translation dated May 14, 2013 issued in Japanese Patent Application No. 2009-552632.

* cited by examiner

INSERT AND A HEATER ELEMENT FOR ELECTRICAL FURNACES

RELATED APPLICATION DATA

This application is a §371 National Stage Application of PCT International Application No. PCT/SE2008/050004 filed Jan. 2, 2008, and claims priority under 35 U.S.C. §119 and/or §365 to Swedish Application No. 0700559-8, filed Mar. 5, 2007.

TECHNICAL FIELD OF THE INVENTION

In a first aspect, this invention relates to an insert intended for electrical furnaces and of the type that comprises on one hand, an insulating shell having an outside and an inside, at least the last-mentioned one of which has a rotationally symmetrical shape around a centre axis, and on the other hand a heater element that is arranged inside the shell and extends a plurality of turns in a continuous loop having an overall shape corresponding to the rotationally symmetrical shape of the shell.

In an additional aspect, the invention also relates to a heater element as such.

PRIOR ART

Furnaces heated in electrical way are often constructed of inserts in the form of a refractory and heat-insulating shell as well as one or more heater element that are mounted inside the same and manufactured from an electrically conducting material, which is suitable to form a resistance element having the ability to emit heat energy when electric current is supplied. In practice, the shell most often consists of a ceramic material, such as ceramic fibres in one or more layers, while the heater elements may consist of wires manufactured from special alloys, such as Fe—Cr—Al, alternatively intermetallic materials, such as Mo—$Si_2$ or the like, or intermetallic composite material. In many types of furnaces, it is of vital importance that the temperature distribution is kept uniform in the furnace space that is charged with materials for treatment. Thus, in certain applications in which, for instance, diffusion furnaces are used, requirements are made that the temperature difference in different points in the furnace space must not exceed 0.1° C. To provide for these requirements, helical heating wires, so-called helices, are particularly well suitable, since the same can be given a uniform pitch without considerable irregularities. A peculiarity of the heating wires, which may have a considerable total length depending on the number of turns therein, is that they are alternatingly expanding and shrinking depending on occurring temperature variations. As a rule of thumb, the wire expands at least 1% when the temperature is raised from room temperature to operating temperature, which usually is above 1000° C. In other words, the wire is extended at least 10 mm per running metre, meaning that a wire having, for instance, a length of 50 m is expanded (and contracted) as much as 500 mm. If the wire would be freely movable, such length variations could be accommodated by axial as well as radial expansion. However, the mobility of the wire mounted inside the insulation shell is limited in various ways. If the same is prevented from increasing the diameter thereof along a part of the axial extension thereof, the expansion, which normally is uniformly distributed, has to be accommodated as a locally greater deformation. This may lead to the wire either being plastically deformed or pressed out in the insulation material. In certain furnace constructions, e.g., diffusion furnaces, the wire loop is mounted at a certain radial distance inside a cylindrical inside of the shell. In order to divide the wire loop into heat zones, welded-on current outlets, e.g., flat irons, project radially from the wire loop and extend radially out through the insulation. In this case, the aim of the wire loop to expand radially requires that the expansion space toward the inside of the shell is sufficiently great, while an aim to expand axially results in stresses adjacent to the outlets.

OBJECTS AND FEATURES OF THE INVENTION

The present invention aims at obviating the above-mentioned shortcomings of previously known furnace inserts and at providing an improved insert. Therefore, a primary object of the invention is to provide a furnace insert the heating wire of which is mounted inside the insulation shell in such a way that accumulation of the inevitable length expansion in the entire wire is counteracted, more precisely with the purpose of avoiding contact between the heating wire and the insulation shell, and to avoid stresses on occurring outlets.

According to the invention, the above-mentioned object is attained by means of the features described herein, such as that the loop comprises a plurality of spaced-apart bends, which divides the same into a plurality of individual sections to which occurring thermal expansion is isolated locally, the sections having an extension in a rotationally symmetrical overall shape around the centre axis.

In an additional aspect, the invention also relates to a heater element as such.

FURTHER ELUCIDATION OF PRIOR ART

By U.S. Pat. No. 6,008,477, an insert for electrical furnaces is previously known comprising an insulating shell and a coiled heater element. In order to prevent accumulation of the expansion of the element wire, the element wire is provided with a plurality of fixing members, which protrude from the element wire and are either directly anchored in the insulation or in contact with support members, which in turn are anchored in the insulation, in such a way that the element wire still can move in relation to the support members. However, in this case, the loop is not provided with a plurality of bends.

By U.S. Pat. No. 4,553,246, an electrical furnace is previously known comprising an insert having a cylindrical basic shape in which a number of generally meander-shaped heater elements are mounted. However, in this case, the meander shape is not orientated axially in respect of the cylindrical basic shape of the insert, but tangentially, the individual meander parts being straight and not bent.

BRIEF DESCRIPTION OF THE APPENDED DRAWINGS

Figure 4:
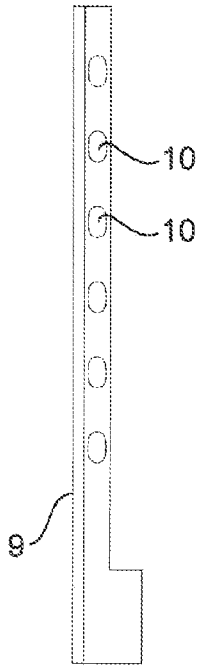
Figure 2:
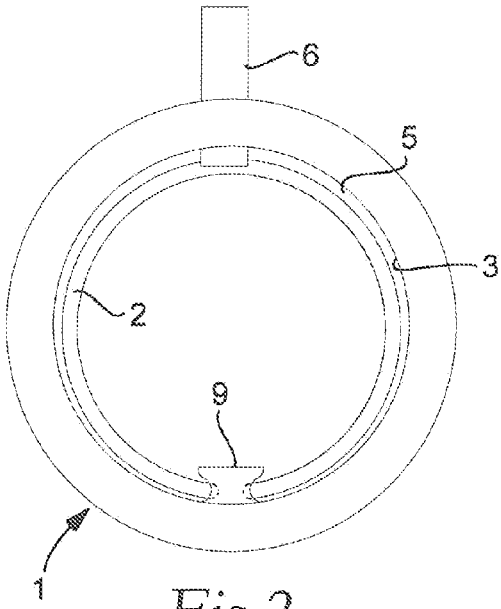
Figure 3:
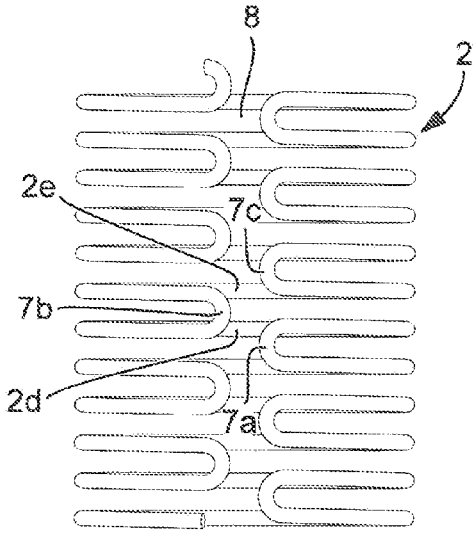
Figure 5:
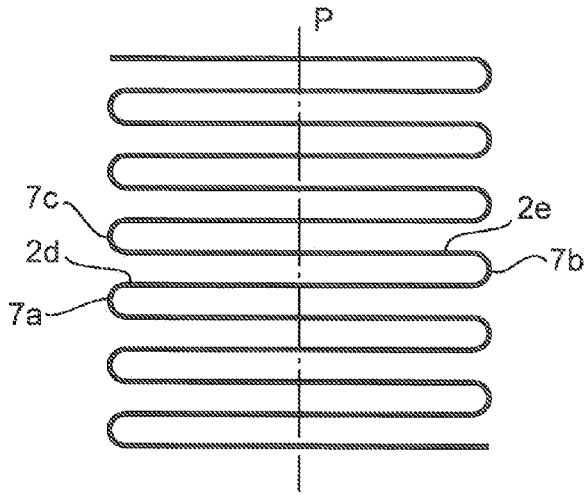
Figure 6:
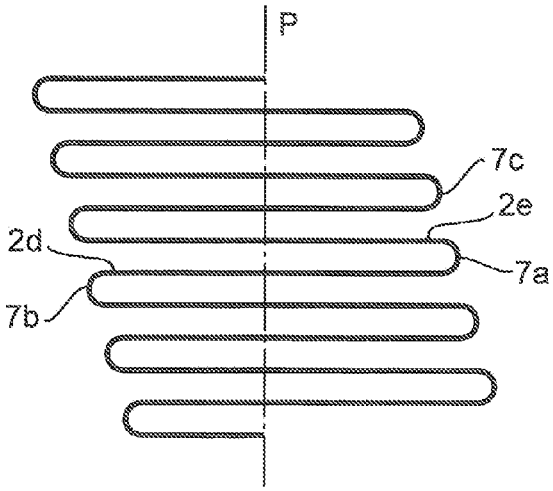
Figure 7:
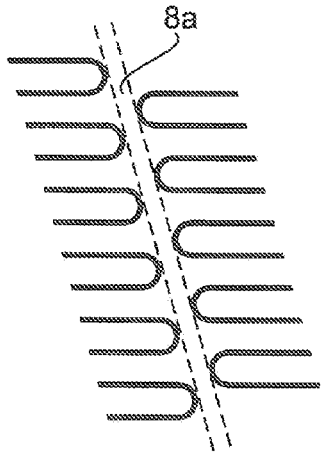
Figure 8:
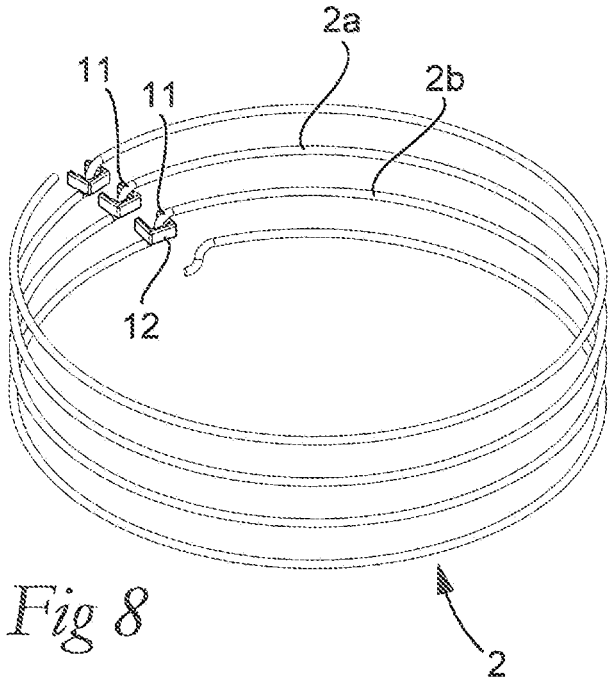
Figure 9:
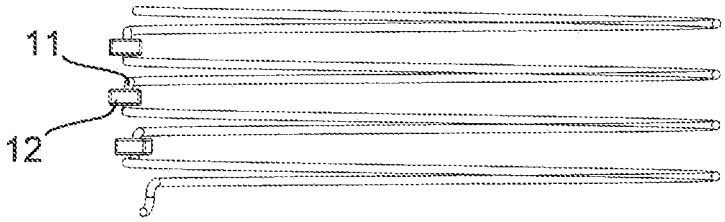

In the drawings:

FIG. 1 is a partly sectioned perspective view showing a furnace insert having a cylindrical insulation shell and a heater element inside the same, FIG. 2 is a planar view from above of the insert, FIG. 3 is a side view of only the heater element, FIG. 4 is a side view of a holder for the heater element, FIG. 5 is a schematic planar view showing the heater element in an imaginary, extended state, FIG. 6 is a planar view of an alternative embodiment of the heater element, FIG. 7 is a sectioned side view of the heater element according to FIG. 6, FIG. 8 is a perspective view of an additional alternative embodiment of the heater element, and FIG. 9 is a side view of the heater element according to FIG. 8.

DETAILED DESCRIPTION OF PREFERRED EMBODIMENTS OF THE INVENTION

The furnace insert shown in FIGS. 1-4 includes an insulating shell 1 and a heater element 2 arranged inside the same, which both have a rotationally symmetrical basic shape around a centre axis C. In FIGS. 1-2, the insulation shell 1 is illustrated as genuinely cylindrical so far that not only the inside 3 thereof, but also the outside 4 thereof, are cylindrical, the shell being open at the axially opposite ends thereof. However, in this connection, it should be pointed out that the geometrical shape of the outside 4 of the shell lacks importance in connection with the invention. Furthermore, it should be pointed out that the insulating shell may have another rotationally symmetrical basic shape, such as conical.

In the example, the heater element 2 has the shape of a wire that extends a plurality of turns in a loop having a cylindrical overall shape. By those skilled in the art, this type of heater element, which consists of a loop extending a plurality of turns in a coiled shape, is often denominated helix. In the illustrated case, the heating wire 2 is placed at a certain distance inside the inside 3 of the insulation shell 1. In other words, the heating wire and the insulation shell are spaced-apart by a ring-shaped gap 5. To the heating wire, outlets 6 are connected, e.g., flat irons, which project radially from the wire and intersects the insulation shell 1.

The material of the insulation shell 1 is not only heat-insulating but also refractory. In practice, the material may consist of ceramic material, for instance ceramic fibres. The material of the heating wire 2 may consist of any electrically conducting material that is suitable to form a resistance element, usually in the form of some special alloy, such as Fe—Cr—Al, or an intermetallic material, such as Mo—$Si_2$. The wire may—but does not need to—have a round cross-section shape having a diameter that for many wires varies within the range of 3-10 mm (depending on the dimensions of the insert). In the example shown, the insert has a comparatively limited axial extension and forms a module that can be built together with a desired number of modules of the same type. The diameter may vary, for instance, within the range of 100-400 mm, while the length may be within the range of 100-1200 mm. Of course, the total length of the heating wire 2 varies depending on the dimensions of the insert. However, in many cases, the wire has a length of between 10 m and 100 m or more.

As far as the shown insert has been described hitherto, the same is in all essentials previously known.

New and characteristic of the embodiment of the insert according to the invention shown in FIGS. 1-4, is that the heating wire 2 is formed with a plurality of spaced-apart bends 7, which in this case are U-shaped and deflects the loop in pair-wise adjacent sections, which run in opposite directions from the individual U-bend. The loop has preferably the same, or substantially the same, diameter in the two pair-wise adjacent sections in respect of the centre axis C, which among other things is seen in FIG. 1. In FIG. 3, three such U-bends are designated 7*a*, 7*b*, 7*c*. From the U-bend 7*b*, a wire section 2*d* runs to the U-bend 7*a*, as well as a wire section 2*e* to the U-bend 7*c*. In such a way, the wire loop is imparted the shape of a meander, more precisely a meander having a curved, rotationally symmetrical overall shape. This means that the loop has a meander shape in the axial extension of the heater element and accordingly, of course also in the axial extension of the insulating shell. According to a preferred embodiment, the wire loop has the shape of a meander having a curved cylindrical overall shape. In this rotationally symmetrical configuration, the adjacent wire sections 2*d*, 2*e* are essentially located in mutually parallel planes, which are perpendicular to the centre axis of the rotationally symmetrical shape (such as the centre axis of the cylinder) and axially spaced-apart from each other. More precisely, two adjacent wire sections are spaced-apart by an interspace determined by the arc radii of the U-bends 7.

To further make clear the geometrical shape of the heating wire, reference is made to FIG. 5, where the wire is shown in an extended state in which it yet has not been given the final cylinder shape thereof. From the figure, it is seen that the individual wire sections 2*d*, 2*e*, all are equally long, and therefore all U-bends 7*a*,7*b*,7*c*, etc., are situated at equally large distances from a common centre plane P, wherein the wire extends in meander shape between axially opposite ends. De facto, the wire is manufactured by first being given the plane meander shape according to FIG. 5, and then—by hot working—the cylindrical overall shape according to FIGS. 1 and 3. Accordingly, in the last-mentioned state, the wire has the same rotationally symmetrical overall shape as the insulation shell 1, i.e., cylindrical.

From FIG. 3, it is seen that a gap or interspace 8 is present between the U-bends 7 facing each other. This has been provided by the fact that the individual wire section, e.g., the section 2*d*, has an arc length that is somewhat smaller than one turn. The heating wire is kept in place inside the insulation shell 1 by means of a holder 9, which is manufactured from an electrically insulating material, and which in the shown, preferred example consists of a bar having rail-like cross-section shape. This bar is inserted in the gaps 8, more precisely in such a way that the different U-bends of the wire loop are kept pressed against opposite sides of the bar. As is seen from FIG. 4, the bar may advantageously be formed with a number of seats or countersinks 10, corresponding to the number of U-bends, in which the U-bends engage. Thus, said seats counteract displacement of the U-bends and thereby determine the position of the wire loop along the bar.

Although the furnace insert is shown in a vertical or upright state in FIG. 1, the same may also be located in a horizontal or lying state. In this case, the holding or supporting bar 9 should be located in the lower part of the cylinder, suitably vertically under the centre axis C. In the last-mentioned case, the bar may simply be inserted in the insulation shell without being anchored in the same.

Reference is now made to FIGS. 6 and 7, which schematically illustrate an alternative embodiment of the heating wire loop. In this case, every second wire section is longer than adjacent wire sections. For instance, the wire section 2*d* is shorter than the adjacent section 2*e*, which results in adjacent U-bends 7*b*, 7*a* being located at differently great distances from a reference plane P perpendicular to the wire sections. Therefore, when the plane, meander-shaped wire is imparted a cylindrical shape, the gaps form a slot 8*a* that extends helically in relation to the centre axis C of the cylinder (instead of axially, such as in the previous case).

In the disclosed heating wire, the inevitable expansion is accommodated locally in the individual U-bend to which a pair of wire sections connect, the forces in said pair repelling each other in the U-bends and therefore aiming to keep the pitch of the wire uniform. In other words, the expansion will be isolated to individual pairs of wire sections of limited length, without being able to propagate into and be accumulated in the other wire sections.

In FIGS. 8 and 9, an additional alternative embodiment is shown of a heating wire according to the invention. In this case, the continuous wire 2 is helical and formed with a plurality of Z-shaped bends 11, which divide the wire into a corresponding number of individual sections or parts 2*a*, 2*b*, etc. In this case, the thermal expansion arising in the wire is isolated to the individual sections. In other words, the thermal expansion of the individual wire section is accommodated in the individual Z-bend 11 without propagating into and being accumulated in the other sections. Also in these figures, the individual sections or parts 2*a*, 2*b*, etc. of the loop have an extension in such a way that they have the same, or substantially the same, diameter around a centre axis of the heater element.

In the embodiment according to FIGS. 8 and 9, the heating wire is kept in place inside the insulation shell by means of a plurality of holder members in the form of staples 12, which are anchored in the insulation shell and project from the inside thereof. Said staples 12 are placed at the wire bends 11, the last-mentioned ones running freely through the staples, i.e., without being fixed to the same.

As is clearly seen in FIGS. 1, 2 and 8, the embodiments described above have the common feature that the heating wire in the sections has an extension in a rotationally symmetrical basic shape around a centre axis of the heater element with the centre axis of the heater element coinciding with the centre axis of the insulating shell.

FEASIBLE MODIFICATIONS OF THE INVENTION

The invention is not limited to the embodiments described above and shown in the drawings. Thus, the heating wire may have an out of round cross-section shape and include a broadest surface facing inward toward the middle of the furnace space. For instance, the wire may be cross-sectionally rectangular. In such a way, the heat radiation of the wire toward the inner of the furnace is optimized. The heater element may also be made so that U-bends facing each other are located right in front of each other, instead of being axially displaced in the way shown in the example. Furthermore, it is feasible that the insulating shell has another rotationally symmetrical shape than cylindrical, in particular conical. In this case, also the heater element will be conically shaped in the axial direction thereof. It is also feasible that the insulating shell has a grooved inside in which grooves the element wire of the heater element runs. The purpose of said grooves is foremost to prevent the heater element from moving too much in the axial direction in respect of the insulating shell.

The invention claimed is:

1. An insert for electrical furnaces, comprising, an insulating shell having an outside and an inside, at least the inside of the insulating shell has a rotationally symmetrical shape around a center axis, and a heater element that is arranged inside the insulating shell and includes a plurality of turns in a continuous loop having an overall shape corresponding to the rotationally symmetrical shape of the inside of the insulating shell, wherein the heater element is spaced apart from the insulating shell, wherein the continuous loop comprises a plurality of spaced-apart bends facing each other to form a gap adapted to receive a holder element, the plurality of spaced-apart bends divide the continuous loop into a plurality of individual sections, each of the plurality of individual sections disposed adjacent at least one of the plurality of spaced-apart bends so that thermal expansion is isolated locally, each of the plurality of individual sections having an extension in a rotationally symmetrical overall shape around the center axis and each of the plurality of individual sections are disposed in a respective one of a plurality of mutually parallel planes which are perpendicular to the center axis, wherein each of the plurality of spaced-apart bends are U-shaped to form a plurality of U-shaped bends, wherein the U-shaped bends are the same distance from said center axis as said individual sections, wherein each of the plurality of U-shaped bends deflect the continuous loop in pair-wise adjacent sections, which run in opposite directions from each of the plurality of U-shaped bends and impart to the continuous loop a meander shape as viewed in the axial extension thereof, wherein the gap is arranged to receive the holder element manufactured from an electrically insulating material against which each of the plurality of U-shaped bends are pressed, and wherein the holder element is formed with a plurality of seats countersunk into opposite sides of the holder element, each of the plurality of seats receiving one of the plurality of U-shaped bends so that the plurality of U-shaped bends are located on both of the opposites sides of the holder element, each of the U-shaped bends pressed against a respective one of the plurality of seats on one of the opposite sides of the holder element, whereby the seats counteract displacement of the plurality of U-shaped bends and determine the position of the heater element along the holder element.

2. The insert according to claim 1, wherein the holder element is long and narrow to serve as support for the plurality of U-shaped bends spaced-apart along the same.

3. The insert according to claim 1, wherein two of the plurality of individual sections, which run from one of the plurality of U-shaped bends to another two of the plurality of U-shaped bends, are differently long so that the gap forms a slot that runs helically in relation to the center axis as it proceeds in an axial direction of the center axis.

4. The insert according to claim 1, wherein the heater element is spaced apart from the insulating shell by a ring-shaped gap.

5. An insert for electrical furnaces, comprising, an insulating shell having an outside and an inside, at least the inside of the insulating shell has a rotationally symmetrical shape around a center axis, and a heater element that is arranged inside the insulating shell and includes a plurality of turns in a continuous loop having an overall shape corresponding to the rotationally symmetrical shape of the inside of the insulating shell, wherein the continuous loop comprises a plurality of spaced-apart bends facing each other to form a gap adapted to receive a holder element, the plurality of spaced-apart bends divide the continuous loop into a plurality of individual sections, each of the plurality of individual sections disposed adjacent at least one of the plurality of spaced-apart bends so that thermal expansion is isolated locally, each of the plurality of individual sections having an extension in a rotationally symmetrical overall shape around the center axis and each of the plurality of individual sections are disposed in a respective one of a plurality of mutually parallel planes which are perpendicular to the center axis, wherein each of the plurality of spaced-apart bends are U-shaped to form a plurality of U-shaped bends, wherein the U-shaped bends are the same distance from said center axis as said individual sections, wherein each of the plurality of U-shaped bends deflect the continuous loop in pair-wise adjacent sections, which run in opposite directions from each of the plurality of U-shaped bends and impart to the continuous loop a meander shape as viewed in the axial extension thereof, wherein the gap is arranged to receive the holder element manufactured from an electrically insulating material against which each of the plurality of U-shaped bends are pressed, and wherein two of the plurality of individual sections, which run from one of the plurality of U-shaped bends to another two of the plurality of U-shaped bends, are differently long so that the gap forms a slot that runs helically in relation to the center axis as it proceeds in an axial direction of the center axis.

* * * * *